United States Patent [19]

Valenzona

[11] Patent Number: 4,950,856

[45] Date of Patent: Aug. 21, 1990

[54] PUSH-BUTTON SWITCH WITH MOMENTARY-ON FEATURE

[75] Inventor: Joseph F. Valenzona, El Torro, Calif.

[73] Assignee: Judco Manufacturing, Inc., Harbor City, Calif.

[21] Appl. No.: 182,915

[22] Filed: Apr. 18, 1988

Related U.S. Application Data

[63] Continuation-in-part of Ser. No. 77,206, Jul. 24, 1987.

[51] Int. Cl.[5] ..... H01H 13/56

[52] U.S. Cl. ..... 200/526; 200/276.1

[58] Field of Search ..... 200/317, 526, 528, 276, 200/276.1

[56] References Cited

U.S. PATENT DOCUMENTS

| | | | |
|---|---|---|---|
| 2,352,653 | 7/1944 | O'Brien | 200/317 |
| 3,790,734 | 2/1974 | Raab et al. | 200/526 |
| 4,175,222 | 11/1979 | Buttner | 200/526 |
| 4,317,015 | 2/1982 | Buttner et al. | 200/526 |
| 4,319,106 | 3/1982 | Armitage | 200/526 |

FOREIGN PATENT DOCUMENTS

| | | | |
|---|---|---|---|
| 860162 | 8/1981 | U.S.S.R. | 200/276.1 |

*Primary Examiner*—Renee S. Luebke

*Attorney, Agent, or Firm*—Kenneth W. Float

[57] ABSTRACT

A miniature push-button switching apparatus having a housing for enclosing a plunger and a rotating ratchet mechanism for engaging and disengaging the switching contacts, the switching apparatus having a "momentary-on" position for temporarily engaging an electrical load in addition to a "stable-on" switch position with the ratchet mechanism employing a helical contact spring as a switching contact, the contact spring increasing the active length of the switching contact for significantly reducing possible spring yielding problems and further exhibiting improved resiliency properties which enhance the ratchet switching mechanism and reduce the possibility of spring distortion.

17 Claims, 4 Drawing Sheets

PUSH-BUTTON SWITCH WITH MOMENTARY-ON FEATURE

This application is a continuation-in-part of pending U.S. patent application identified by Ser. No. 077,206 filed on July 24, 1987.

BACKGROUND OF THE INVENTION

This invention generally relates to electrical switch construction and more particularly to push-button electrical switch construction of the type having a spring-loaded actuator for momentary-on electrical contact and for stable-on electrical contact.

In the field of electrical switch construction, push-button switches that provide connections between a first terminal located on the push-button and a second terminal in the body of the switch are extremely useful for a number of applications. Such switches are employed in a number of electrical and electronic applications which may include electrical appliances, hand-held electrically operated devices and a plurality of automotive electrical applications for both direct and alternating current.

One conventional method of constructing such push-button switches consists of mounting a miniature switch mechanism beneath a push-button. The push-button operates a ratchet or other mechanical device that moves the single-throw miniature switch to different positions upon repeated actuation of the push-button. While such an assembly is useful for many purposes and provides a relatively simple and robust construction, the life expectancy or longevity of such a switch is limited. Such push-button switches are not designed for repetitive operation such that the components of the switch tended to wear rapidly.

Push-button switches of the past employed a cantilever type spring for making electrical contact between the spring-loaded switching mechanism and a fixed terminal in electrical communication with an electrical conductor. Once the push-button switch was activated, a pathway was created for the transfer of electrical load through the fixed terminal of the switch.

A cantilever spring is a straight member mechanically attached at only one end. The attached end is normally connected to the fixed terminal in the bottom cover portion while the shaft of the cantilever spring includes sufficient flexibility to connect and disconnect the electrical circuit upon contacting a conductive element operated by the push-button actuator. A particular example of one such push-button switching device employs a biasing spring and a compound cantilever spring. The cantilever spring must be accurately positioned within the bottom cover portion to maintain the proper switching tolerances with respect to a movable metallic cup contact. The push-button switching device utilizes a vertical spline design. Thus, once the push-button and biasing spring are depressed beyond the point of ratchet, the metallic cup contact is rotated to the first "on-position" in contact with the cantilever spring.

During the next operation of the push-button, the cup contact is rotated again separating it from the cantilever spring for achieving the second "on-position". In the second "on-position", the biasing spring is relaxed permitting the ratchet mechanism to travel to the top of the recesses located between the vertical splines. In this position, the cup contact completes electrical communication with a stationary contact for energizing a second circuit. Thus, in this example, the switch completes an electrical circuit in both positions. Further, partial deflection of the push-button which is insufficient to exceed the point of ratchet results in momentary contact between the cup contact and the cantilever spring.

After a plurality of operations, the cantilever spring tends to adopt a permanent set position with respect to the actuator terminal because of a loss of resiliency. The loss of resiliency is due to the short active length of the cantilever spring resulting in less stability with a higher probability of deformation to a permanent set position. Further, the cantilever spring has a tendency to yield which causes the cantilever spring to shorten and to lose contact with the actuator terminal of the push-button switch. This causes the push-button switch to loose its effectiveness as a switching device.

Another example employs a push-button switch for electronic equipment having reduced size, improved reliability and stabilized contact resistance by employing a coil spring having a large diameter base section with a reduced diameter top section. The improvements are achieved by bending that part of the coil spring having the reduced diameter into the spring to face the side of the larger diameter base. The inner surface of the push-button is shaped like a truncated cone whose lateral surface is a guide for the coil spring mounted in the push-button.

When the push-button is depressed, the coil spring is compressed so that the reduced diameter section of the coil spring touches a pair of contacts to complete the electrical circuit between the contacts via the spring. After complete depression, the push-button is seated with its conical surface on the lateral surface of the coil spring. Contact pressure is acquired by having the reduced diameter section of the coil spring facing in the direction of the larger diameter section. This push-button switch provides only momentary contact.

A third example teaches a switch of the tumbler type which employs a mercury button for electrical contacts. Rotation of a finger member over a limited arc is effective to open or close an electric circuit according to the direction in which the finger piece is rotated. A lamp or other indicating means is employed to operate either as a "pilot" or a "beacon" according to whether the lamp is connected in series or parallel with the switch conductors. This switch does not utilize a ratchet indexing device.

Another example includes a small versatile electrical switch suitable for the control of low current electrical devices employing a biasing spring, a ratchet indexing device, and a pair of symmetrically spaced terminals for completing an electrical circuit. Two final examples each include a pair of coil springs with the first switch comprising a push-button which is movable in a casing and enclosed by a boot made of flexible material. The first switch includes linkage for rotating the switch during successive switching operations. The second switch comprises an alternate action push-button switch which converts longitudinal motion of the push-button to alternate circumferential rotation of a rotating means. The rotating means alternately opens and closes a contact.

Hence, those concerned with the development and use of push-button switching devices in the electrical field have long recognized the need for improved push-button switches which extend the longevity of the switch by improving the resiliency of the actuator terminal and which eliminates permanent deformation and yielding of the spring for improved operation. The present invention fulfils all of these needs.

SUMMARY OF THE INVENTION

Briefly, and in general terms, the present invention provides a push-button switch construction which substantially increases the life of the switch by employing a helical contact spring in the actuator ratchet mechanism which increases the active length of the spring configuration and reduces the spring yielding factor, and which significantly increases the resiliency of the actuator terminal over similar type switches of the prior art. Moreover, the push-button switch construction of the present invention is lightweight and comprised of reliable components which provide both a momentary-on connection feature in addition to a stable-on connection feature and is relatively trouble-free and reliable in use.

Basically, the present invention is directed to an improved push-button switching apparatus for providing a momentary contact feature and a stable contact feature for use in a plurality of electrical and electronic applications, including appliances and motor vehicles and further for increasing the switching life of such a push-button device. This result is accomplished by incorporating a helical contact spring as an actuator switching device in combination with a plunger ratchet mechanism which operates a single-throw miniature switch to different positions upon the repeated actuation of the push-button.

In accordance with the invention, the push-button switching apparatus includes a construction comprised of a housing having a cover portion for enclosing the input and output terminals of an electrical circuit. The housing further includes a body portion having a push-button actuator device protruding from the top thereof which is in mechanical communication with a rotating ratchet mechanism. Mounted within the ratchet mechanism is a movable metallic cup member having a biasing spring loosely inserted within the cup member and a helical contact spring securely mounted to the exterior of the cup member.

Upon activation of the push-button actuator, the rotating ratchet mechanism permits the helical contact spring to either engage or disengage from a position which connects the input terminal to the output terminal. In a first ratchet position, the input terminal is connected to the biasing spring which is electrically isolated from the output terminal. Upon activation of the push-button, the ratchet mechanism rotates to a second position in which the input terminal is electrically connected to the output terminal via a mechanical connection between the biasing spring, the metallic cup member and the contact spring, providing a "stable-on" connection.

In addition, if the push-button actuator is operated with a force insufficient to rotate the ratchet mechanism but sufficient to establish electrical contact, a temporary electrical connection exists between the input terminal and the output terminal. The connection exists for the duration of time that the push-button actuator is depressed. This construction provides a "momentary-on" feature providing an electrical connnection for an undefined period of time.

In accordance with the invention, the push-button switching apparatus may be employed for speciality applications, such as an artificial light source by incorporating a lamp into the electrical circuitry. Further, the switch may also be employed for general applications, such as the operation of electrical appliances, auxiliary electrical loads or control functions within an automobile.

The new and improved push-button switching apparatus of the present invention is lightweight and comprised of rugged components for providing reliable operation. The push-button construction provides for a longer switching life by incorporating a helical contact spring which increases the active length of the actuator terminal and substantially reduces the problem of actuator deformation by providing a high resiliency contact spring component. Further, the spring yielding factor is reduced by employing a helical element so that the actuator contact spring is not shortened after repeated operation leading to poor electrical conductivity.

These and other objects and advantages of the invention will become apparent from the following more detailed description, when taken in conjunction with the accompanying drawings, which illustrate, by way of example, the features of the invention.

DETAILED DESCRIPTION OF THE PREFERRED EMBODIMENT

Figure 1:
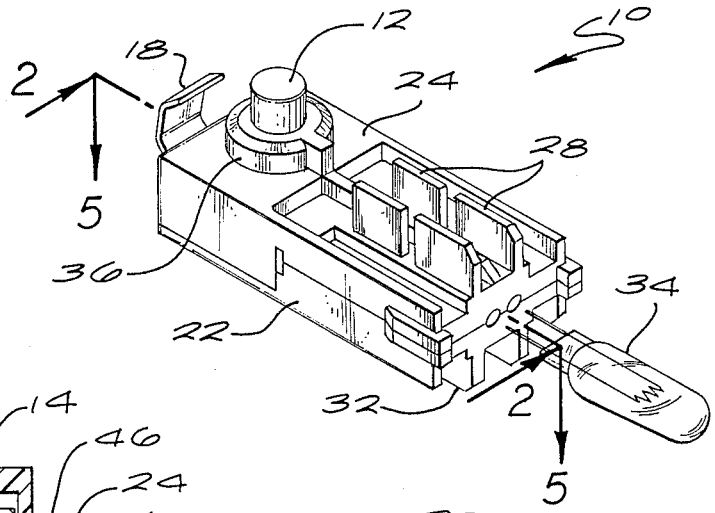
FIG. 1 is a perspective view of a push-button switch in accordance with the present invention.

As shown in the drawings for purposes of illustration, the invention is embodied in a miniature push-button switch 10 of the type having a bias spring-loaded plunger 12 for operating a rotating ratchet mechanism 14 which controls the position of a helical contact spring 16 which acts to engage or disengage the electrical connection between an input terminal 18 and an output terminal 20 depending on the position of the ratchet mechanism.

Push-button switches of the past employed a cantilever type spring for making electrical contact between the spring-loaded switching mechanism and a fixed terminal in electrical communication with an electrical conductor which provided a pathway for the transfer of electrical charge. The cantilever spring was a straight member mechanically attached at one end to a fixed terminal in the bottom cover portion. Ideally, the shaft of the cantilever spring included sufficient flexibility to connect and disconnect the electrical circuit upon contacting the conductive element operated by the push-button actuator.

Over time, the cantilever spring tended to adopt a permanent set position with respect to the actuator terminal because of a loss of resiliency which was due to the short active length of the cantilever spring. The adoption of the permanent set position resulted in less stability leading to a higher probability of deformation of the cantilever spring. The spring also had a tendency to yield which caused the cantilever spring to shorten and to lose contact with the actuator terminal of the push-button switch resulting in a loss in the effectiveness as a switching device.

In accordance with the present invention, the rotating ratchet mechanism 14 and the helical contact spring 16 cooperate to connect and disconnect the input terminal 18 to and from the output terminal 20 through the operation of the bias spring-loaded plunger 12 and to significantly increase the longevity of the push-button switch 10 by increasing the active length of the contact spring configuration and reducing the contact spring yielding factor by improving the resiliency of the actuator terminal. Further, the push-button switch is lightweight and comprised of rugged components for providing reliable operation and for substantially reducing the problem of actuator deformation and spring yielding for maintaining good electrical conductivity.

The push-button switch 10 includes a bottom cover portion 22 and a top body portion 24 which are press-fitted together, as shown in FIG. 1. The bottom cover and top body portions are molded in plastic with the body portion including a vertically extending port 26 located in a first half of the body portion through which the plunger 12 protrudes. Two pair of upwardly extending fins 28 are carried by a second half of the body portion and are centrally located thereon.

Figure 6:
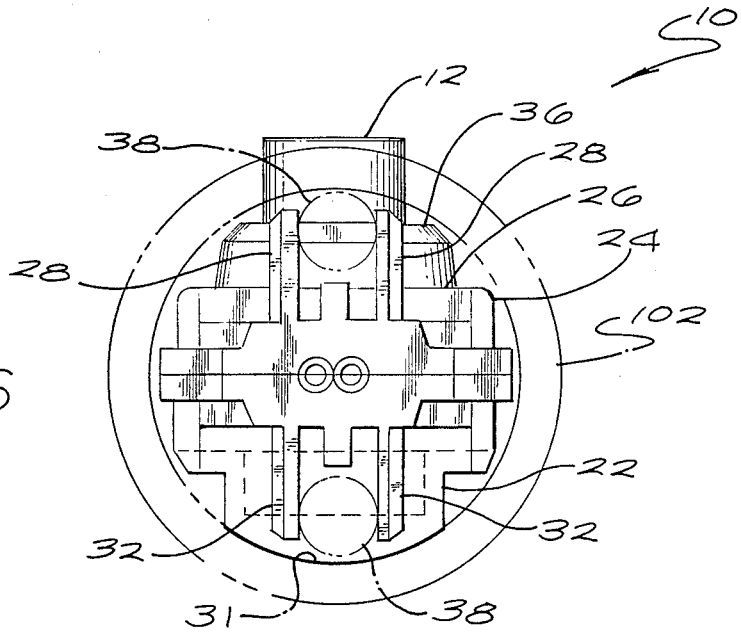
FIG. 6 is an end elevational view of the push-button switch of FIG. 1.

The bottom cover portion 22 includes a centrally located well 30 positioned in a first half of the cover portion for accommodating the helical contact spring 16. An external surface 31 of the first half of the cover portion is outwardly curved for accommodating the centrally located well 30 as shown in FIG. 6 but may be alternately shaped to satisfy design requirements. On a second half of the bottom cover portion, two pair of downwardly extending fins 32 appear which are symmetrically located opposite the upwardly extending fins 28 of the top body portion 24.

Figure 5:
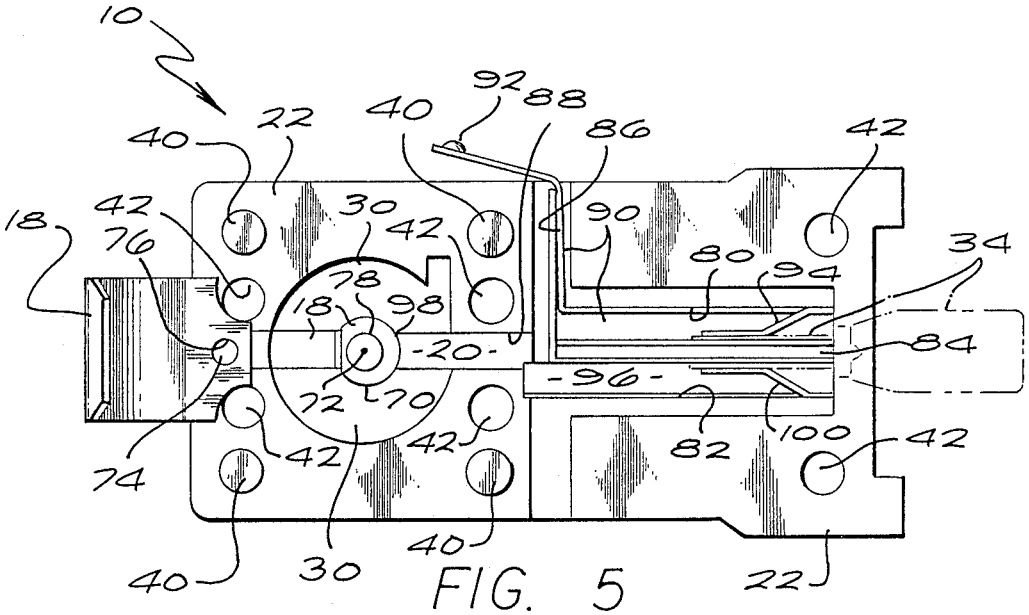
FIG. 5 is a planar view of the bottom cover portion of the push-button switch of FIG. 1.

The input terminal 18 is designed to exhibit resilient springlike properties having a large surface area for assuring contact with an electrical energy source, such as a battery, and may have the appropriate electrical characteristics to accommodate a range of alternating and direct current voltages. The output terminal 20 extends from the end of the switch 10 in the centrally located well 30 to a light bulb 34 and is shown best in FIG. 5. The light bulb 34 is for providing visible electromagnetic radiation and is shown extending from the interface between the bottom cover portion 22 and the top body portion 24. Also, the vertically extending port 26 includes a collar 36 for providing lateral support to the plunger 12.

Figure 2:
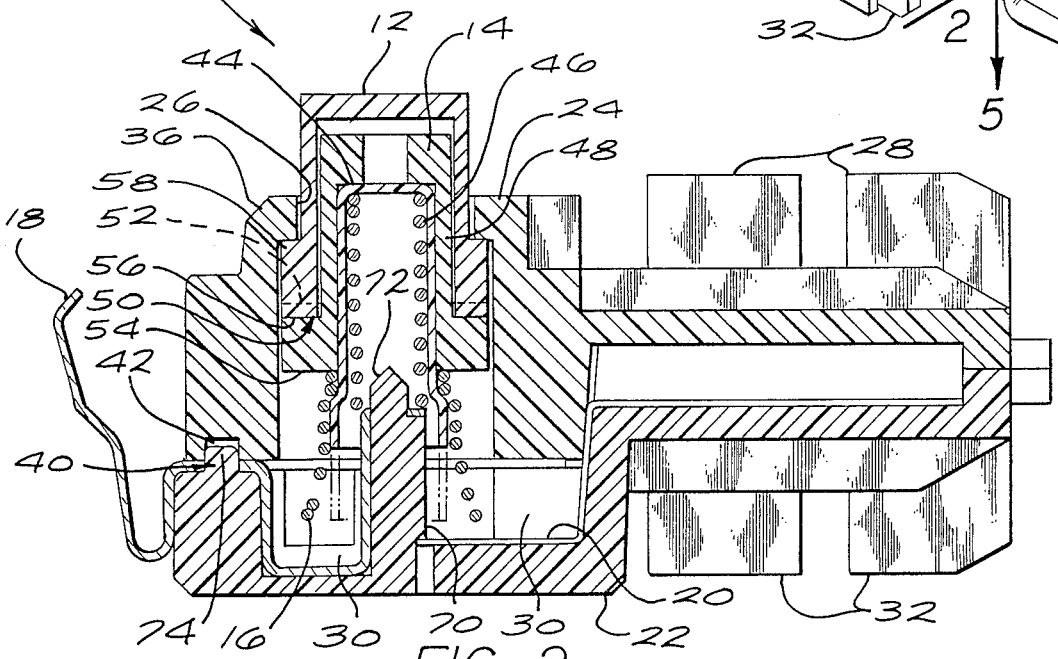
FIG. 2 is a cross-sectional view of the push-button switch taken along the line 2—2 of FIG. 1.
Figure 4:
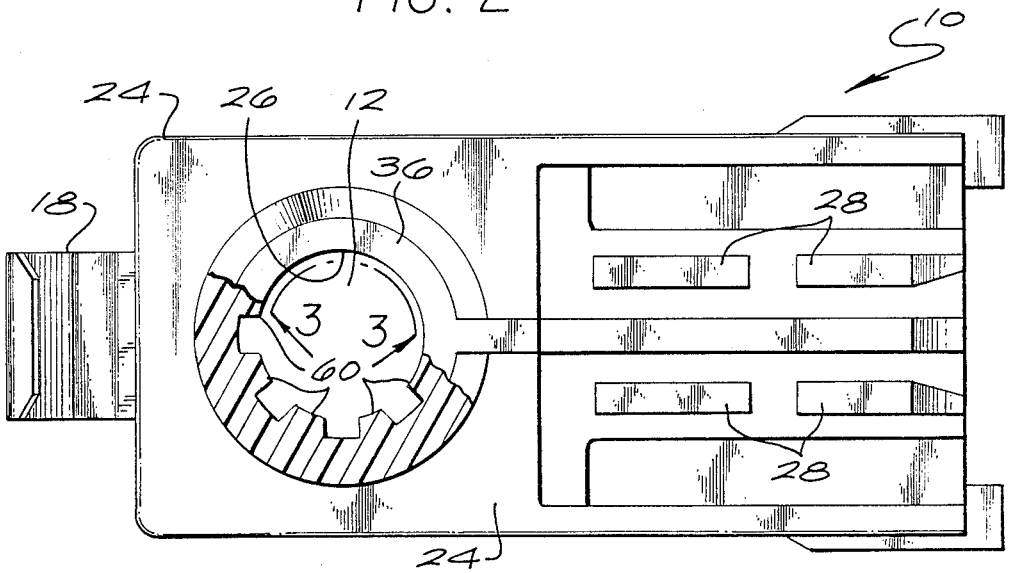
FIG. 4 is an enlarged planar view, partly in cut-away section, of the top body portion of the push-button switch of FIG. 1.

The bottom cover portion 22 and the top body portion 24 are press-fitted together in a post and hole interference fit fashion employing a plurality of posts 40 with a matching plurality of holes 42 (shown best in FIG. 2). The plunger 12 is shown as a cylindrical structure surrounding the ratchet mechanism 14. The ratchet mechanism is also shown as a cylindrical structure surrounding an inner movable metallic cup 44 which is hollow and which houses a biasing spring 46. The biasing spring 46 is a constant diameter cylindrical compression-type helical spring which provides a constant bias to the plunger 12. The bottom portion of the movable metallic cup 44 is slightly flared for securing the helical contact spring 16 which is securely mounted above the external flared portion of the metallic cup. The combination of the biasing spring 46, the contact spring 16 and the movable metallic cup 44 provide that portion of the push-button switch 10 which passes electrical current.

The contact spring 16, being helical in nature, includes a first end having a smaller diameter affixed above the flared end of the metallic cup 44 and a second end having a larger diameter. The second end extends below the flared end of the metallic cup 44 when the contact spring 16 is in the uncompressed state. The contact spring 16, designed to act as an electrical current carrying conductor, is in contact with the input terminal 18 through the metallic cup 44 and the biasing spring 46. Further, the contact spring 16 intermittently contacts the output terminal 20 with the larger diameter second end depending upon the position of the ratchet mechanism 14. It is the electrical communication between the biasing spring 46 and the contact spring 16 within the metallic cup 44 which connects and disconnects the electrical circuit through the switch 10. Although the contact spring 16 is securely mounted about the exterior surface of the metallic cup 44, the biasing spring 46 is loosely mounted within the metallic cup. However, the biasing spring 46 is securely held in position upon the assembly of the switch 10 as is explained hereinafter.

The ratchet mechanism 14 includes a cylindrical sleeve 48 having a hollow interior and a closed end for accommodating the metallic cup 44. The ratchet sleeve 48 slides over the metallic cup to the point where the bottom outer surface of the metallic cup is flared and where the narrow portion of the contact spring 16 is affixed. The ratchet sleeve 48 includes a ledge 50 formed about the outer bottom circumference of the sleeve 48 and having a plurality of upwardly extending serrated teeth 52 and a plurality of upward protuberances 54 extending from the ledge 50 and defining four quadrants. One full serrated tooth 52 is formed between each of the upward protuberances 54 which are equally distributed about the bottom circumference of the sleeve 48.

The plunger 12 includes a cylindrical hollow sleeve having a closed end and a bottom circumference which includes a plurality of downwardly extending serrated teeth 56 and a plurality of downward protuberances 58 extending therefrom. A single downwardly extending serrated tooth 56 is formed between each adjacent set of downward protuberances 58. Note that when the cylindrical structure of the ratchet mechanism 14 is inserted into the hollow sleeve of the plunger 12, the upwardly extending serrated teeth 52 mesh with the downwardly extending serrated teeth 56 and that the plurality of upward protuberances 54 of the ratchet mechanism are offset from the plurality of downward protuberances 58 of the plunger providing an interlocking fit. The upward protuberances 54 of the ratchet mechanism 14 are ramp-shaped to promote the interlocking fit. During operation, the plunger 12 experiences translational travel through the vertically extending port 26 but the ramp-shaped surfaces on the upward protuberances 54 permit the ratchet mechanism 14 and the metallic cup 44 to rotate with respect to the plunger 12 as hereinafter described.

Figure 3:
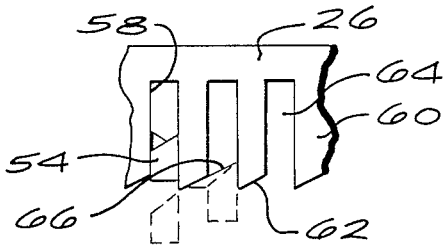
FIG. 3 is an enlarged fragmentary elevational view of the inner circumference of the vertically extending port taken substantially along line 3—3 of FIG. 4.

The vertically extending port 26 of the top body portion 24 includes a plurality of vertical splines 60 molded into the interior surface of the port 26, as is illustrated in FIG. 3. The splines are distributed about the inner circumference of the port 26 at regular intervals with each of the splines 60 extending to approximately two-thirds of the depth of the port. Each spline 60 has a terminal end 62 that is wedge shaped to permit a complementary shaped object, such as the ramp-shaped surfaces on the upward protuberances 54, to slide across the wedge into a space 64 bounded by two of the parallel splines and the inner wall of the port 26.

A ledge 66 is formed between alternate vertical splines 60 such that the upward protuberance 54 of the ratchet mechanism 14 cannot slide into the space 64 between the alternate parallel splines. However, the hollow space 64 between the next adjacent pair of splines 60 will accommodate one of the upward protuberances 54 when there positioned. The ledge 66 located between alternately spaced splines 60 is ramp shaped for mating with the ramp-shaped surface of the upward protuberances 54 and aligned with the wedge shaped terminal end 62 of one of the adjacent splines.

Generally, the motion associated with a single cycle of actuation of the ratchet mechanism 14 is as follows. The ratchet mechanism 14 is slidably mounted within the plunger 12 while the combination of the plunger and ratchet mechanism is slidably mounted within the vertically extending port 26 of the top body portion 24. The plurality of downward protuberances 58 of the plunger 12 extend radially outwardly into the space 64 between the splines 60. The mating plurality of upward protuberances 54 of the ratchet mechanism 14 also extend radially into the same spaces 64 as the downward protuberances 58 when the switch 10 is in the disengaged position.

The terminal end 62 of the splines 60 and the ramp-shaped ledge 66 are in an aligned position with the downward protuberances 58 when the plunger 12 is depressed to approximately its maximum travel. The upward protuberances 54 and the downward protuberances 58 are aligned at each side. When the plunger is actuated, the downward protuberances 58 depress the upward protuberances 54 downwardly between the parallel splines 60 until the downward protuberances 58 reach approximately its maximum stroke. Assuming that one of the ramp-shaped ledges 66 exists between the next adjacent pair of splines, the upward protuberances 54 of the ratchet mechanism 14 then ride down the terminal end 62 of the spline onto the ramp-shaped ledge 66. The plunger 12 then begins its retraction with the corresponding upward travel of protuberances 58.

Once the upward protuberances 54 have passed the terminal end 62 of the splines 60, the upward protuberances 54 rest upon the ledge 66 located between the particular adjacent splines. When the upward protuberance 54 rest upon the ledge, the upwardly extending serrated teeth 52 are separated from the downwardly extending serrated teeth 56 and the contact spring 16 is in the depressed position closing the switch 10 as hereinafter described.

With the upward protuberances 54 resting on the ramp-shaped ledge 66 between the splines 60, the push-button switch 10 is closed and electrically conductive. If the plunger 12 is depressed again, the downward protuberances 58 force the upward protuberances 54 off of the ledge 66. When the downward protuberances 58 reach approximately their maximum stroke, the ramp-shaped surface of the upward protuberances 54 are aligned with the terminal ends 62 of the next adjacent splines 60.

After activation, the plunger 12 again begins to retract with the corresponding upward travel of the downward protuberances 58. However, the upward protuberances 54 will slide into the space 64 between the next adjacent pair of splines 60 and the wall of the port 26 meshing the upwardly extending serrated teeth 52 with the downwardly extending serrated teeth 56 causing the contact spring 16 to relax opening the switch 10 as hereinafter described. Further operation of the plunger 12 repeats the single cycle actuation of the ratchet mechanism 14 causing the ratchet mechanism to rotate.

The input terminal 18 is curved in such a fashion as to ensure good electrical contact with an electrical source, as is illustrated in FIGS. 1, 2, 4, and 5. The top body portion 24 is a unibody construction and is comprised preferably of molded plastic. The upwardly extending fins 28 are also an integrally molded part of the top body portion 24 and provide a convenient storage space for a plurality of spare bulbs 38, as is shown clearly in FIG. 6.

The centrally located well 30 which is located in the bottom cover portion 22 further includes a center post 70 having a cone head 72. The bottom cover portion 22 also includes an aligning and retaining stud 74 located between adjacent holes 42. The input terminal 18 is a metallic copper-based preformed terminal connector which is shaped to fit the inner structure of the centrally located well 30 at the back side of the bottom cover portion. The input terminal includes a first mounting hole 76 for fitting over the aligning and retaining stud 74 for assuring the proper positioning of the terminal. At a distal end of the input terminal 18, a second mounting hole 78 is provided for fitting over the cone head 72 of the center post 70.

The bottom cover portion 22 further includes a first channel 80 parallel to a second channel 82. The first channel 80 is isolated from the second channel 82 by a separation rib 84 which is integrally molded to the bottom cover portion 22 and is comprised preferably of insulating molded plastic. The first channel 80 extends to the center of the cover portion 22 and forms a right angle terminating the first channel at a side exit 86 of the cover portion.

The second channel 82 terminates at the midpoint of the cover portion, however, a groove 88 is formed in the structure of the cover portion 22 leading from the second channel into the centrally located well 30. A ground conductor 90 and an associated ground terminal 92 are comprised of a metallic copper-based preformed wire shaped to fit the path provided by the first channel 80. The ground conductor 90 includes the head of the ground terminal 92 at one end and a spring cantilever clip 94 located at an opposite end for providing an electrical contact to the light bulb 34. The ground conductor 90 and the associated ground terminal 92 are independent of the switching function and are included solely for completing the circuit external to the switch 10.

The second channel 82 carries an output conductor 96 which is a metallic copper-based conductor preformed to fit the shape of the second channel 82. At one end of the output conductor 96 is the output terminal 20 which is seated in a small opening 98 at the base of the center post 70. The output conductor 96 is shaped to fit the groove 88 and the second channel 82. Also, the output conductor 96 terminates with a spring cantilever clip 100 at an end opposite to the output terminal 20. The spring cantilever clip 100 locks the output conductor 96 into the second channel 82 and also provides a connection point to the light bulb 34.

Each of the electrical conductors within the switch 10 are preferably comprised of beryllium copper or in the alternative phosphor bronze, each of which will ensure good electrical conductivity along the conductors and terminals. The switch 10 may be employed in an alternating or direct current circuit and may be designed for a broad power dissipation range depending upon the applied line voltage. The alternating current circuit rating is 120 volts single phase at 60 hertz, however, the switch may be designed for higher alternating current voltages such as 208/240 vac. A direct current voltage rating would be, for example, fourteen volts. The correct voltage and amperage rating of the switch depends upon the design and application of the push-button switch 10.

In light of the previous description of the ratchet mechanism 14, the input terminal 18, the output terminal 20, and the output conductor 96, the electrical connections are as follows. The biasing spring 46 is loosely mounted within the metallic cup 44 and upon assembly the biasing spring is mounted directly upon the input terminal 18 fitted around the cone head 72 of the center post 70. The contact spring 16 is attached above the flared portion of the metallic cup 44 at its smaller diameter end as is shown in FIG. 2.

As the plunger 12 is sequentially operated, the plurality of upward protuberances 54 of the ratchet mechanism 14 rotate within the plurality of splines 60 of the vertically extending port 26. When the plurality of upward protuberances 54 are seated on the ramp shaped ledge 66 between adjacent splines, the larger diameter end of the contact spring 16 communicates with the output terminal 20 while the biasing spring 46 is in electrical communication with the input terminal 18 within the metallic cup 44. Under these conditions, a pathway for electrical current flow exists so that the bulb 34 emits visible electromagnetic radiation. When the plunger 12 is operated again, the plurality of upward protuberances 54 of the ratchet mechanism 14 will slide along the ramp-shaped ledge 66 between adjacent splines 60 and rise to the top of the next pair of adjacent splines. In this posture, a portion of the potential energy stored in the biasing spring 46 is released and the contact spring 16 is raised above the output terminal 20 opening the electrical circuit to the light bulb 34.

The light bulb 34 may be a miniature incandescent lamp with two leads extending therefrom which are inserted into the spring cantilever clips 94 and 100 for completing the electrical circuit. However, any of a plurality of electrical loads would be an acceptable substitute, for example, an annunciator load, an electronic load, a relay, an electrical horn, or the like. An end view of the push-button switch 10 illustrating the upwardly extending fins 28 for storing the spare bulbs 38 is shown in FIG. 6. The push-buttom switch 10 may be incorporated, for example, in the housing of a flashlight 102. The plunger 12 may be encased within a water-tight enclosure located within the flashlight housing 102 and is activated by manual operation. If the water-tight enclosure or rubberized boot is removed, the plunger 12 of the switch 10 protrudes outwardly.

The contact spring 16 is actually a wound cantilever spring having a longer active length which provides more stability and resiliency than the cantilever spring of the past. Therefore, there is less probability that the contact spring will yield and become shorter eliminating the potential result of poor electrical contact. Further, since the contact spring possesses greater resiliency, the tendency for the contact spring to set into a permanent position causing improper operation of the switch is reduced.

The push-button switch 10 includes both a "stable-on" feature and a "momentary-on" feature. The extensive discussion with regard to the ratchet mechanism 14 in relation to FIG. 3 aptly describes the stable-on feature. Repeated operation of the plunger 12 permits the ratchet mechanism to rotate with each operation resulting in serial engagement and disengagement of the switch. With this feature, the switch 10 acts as an on/off interrupting device which can be employed, for example, to operate a flashlight or any other device employing circuit annunciation, such as with light bulb 34.

The "momentary-on" feature provides a distinct advantage to the instant invention. To initiate the "momentary-on" feature, the plunger 12 is operated with a modicum of pressure which is insufficient to operate the ratchet mechanism 14. However, as can be seen in FIGS. 2 and 3, the plunger through the ratchet mechanism applies sufficient pressure to the metallic cup 44 to depress the biasing spring 46 and the contact spring 16. Under these conditions, the contact spring makes electrical contact with the output terminal 20, while the biasing spring 46 makes electrical contact with the input terminal 18.

Further, upon depressing the plunger 12, the biasing spring 46 and the contact spring 16 make electrical contact within the metallic cup 44 completing the electrical circuit and lighting the light bulb 34. The light bulb will remain energized during the period of time in which the plunger 12 is depressed with sufficient pressure to complete the electrical circuit. However, since operational pressure was not applied to the plunger 12, the ratchet mechanism 14 does not index and therefore upon releasing the plunger, the electrical circuit is broken and the lamp 34 extinguishes. The addition of the "momentary-on" feature is useful in a plurality of situations in which artificial light or annunciation is desired only for a short period of time. Further, upon applying a greater force to the plunger operating the ratchet mechanism, the "momentary-on" feature is eliminated and the "stable-on" feature may be established.

Figure 7:
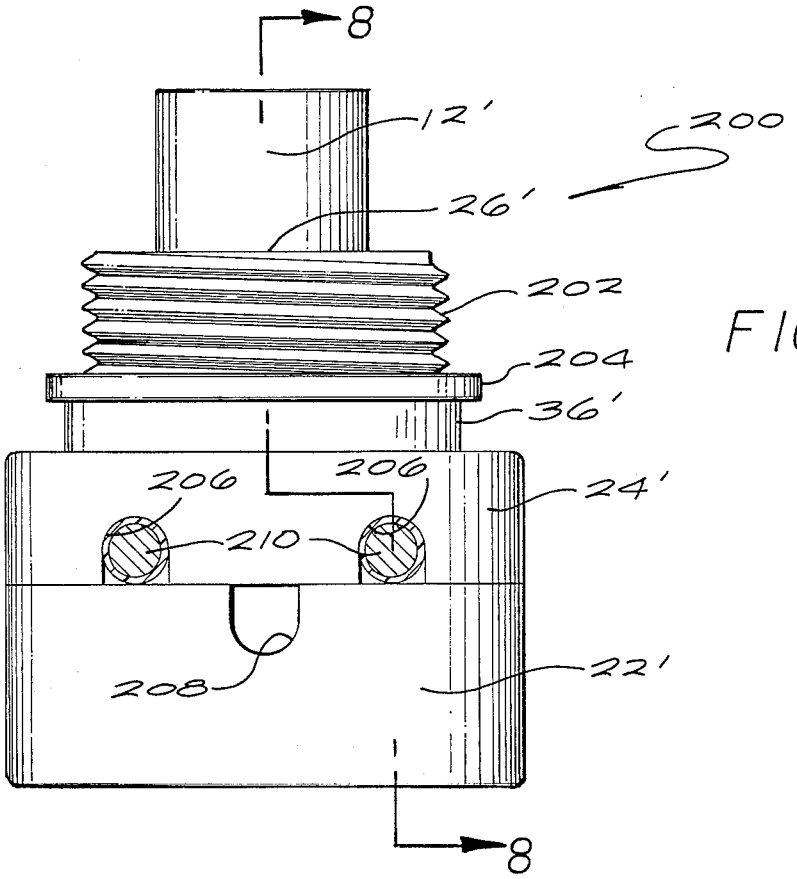
FIG. 7 is an elevational view of an alternative embodiment of the push-button switch of the present invention.

An alternative embodiment of the present invention illustrating a miniature push-button switch is identified by the general reference character 200 and is illustrated in FIG. 7. In this instance, the second embodiment of the push-button switch in FIGS. 7–10 also is of the "stable-on/momentary-on" type similar to the push-button switch of FIGS. 1–6. Structural parts of the push-button switch of FIGS. 7–10 which find substantial correspondence in structure and function to those parts of FIGS. 1–6 are designated with corresponding but primed reference numerals.

The push-button switch 200 includes a spring-loaded plunger 12' projecting from the top of a vertically extending port 26' having a collar 36' which includes a plurality of threads 202 as shown in FIG. 7. Surrounding the top of the collar 36' and located at the base of the threads 202 is a flange 204 utilized in assisting the structural mounting of the switch 200. The plurality of threads 202 and the flange 204 provide an alternative switch mounting means, for example, onto a panel having a circular shaped cutout for accommodating the passage of the plunger 12' and the threads 202 of the switch 200. Immediately below the collar 36' is a top body portion 24' which includes two symmetrically positioned openings 206 for accommodating the insertion of electrical lines.

Note that the top body portion 24', the collar 36', the plurality of threads 202, and the flange 204 represent an integrally molded unibody construction comprised preferably of insulated plastic. The top body portion 24' is mated with a bottom cover portion 22' in a post and hole interference fit construction as was the push-button switch 10 of the preferred embodiment. The cover portion 22' includes a center opening 208 for accommodating the potential insertion of a third electrical conductor (not shown). The center opening 208 is located symmetrically with respect to the spaced openings 206.

Figure 9:
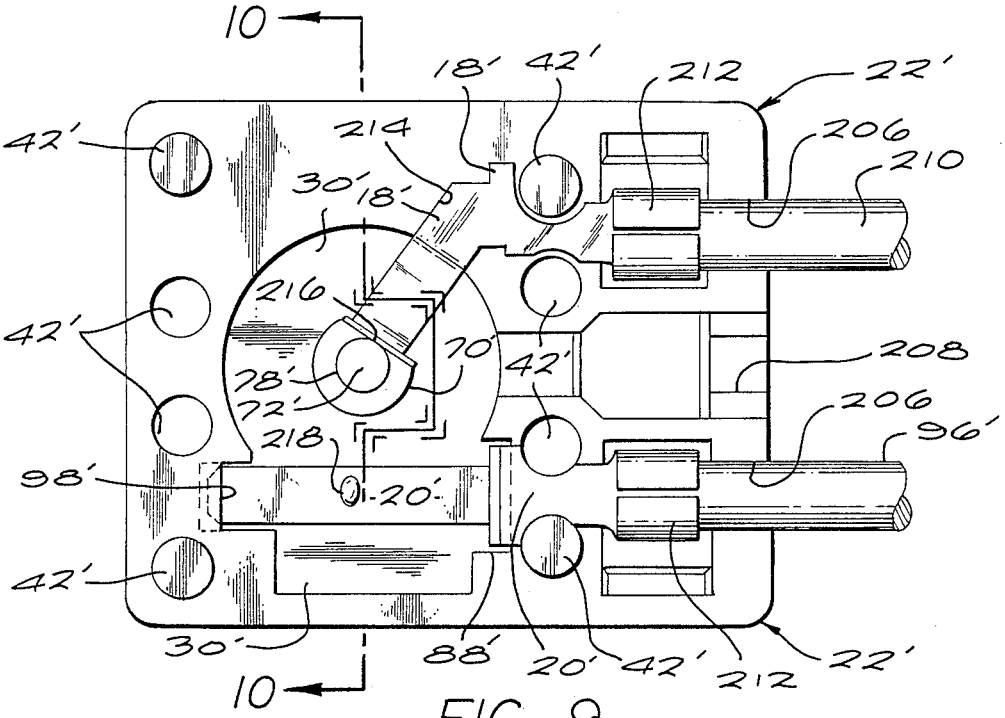
FIG. 9 is a planar view of the bottom cover portion of the push-button switch of FIG. 7.

The bottom cover portion 22' is comprised of insulating molded plastic with the center opening 208 formed therein. An electrical conductor 210 is shown extending through one of the symmetrically spaced openings 206, as is illustrated in FIG. 9. The bottom cover portion 22' further includes a center post 70' having a cone head 72' which acts to receive an input terminal 18' via a mounting hole 78' (seen best in FIG. 9).

The top body portion 24' incorporates a ratchet mechanism 14' which includes a helical contact spring 16', an inner movable metallic cup 44', a biasing spring 46', a ratchet cylindrical sleeve 48', a ratchet sleeve ledge 50', a plurality of upward extending serrated teeth 52', a plurality of ratchet upward protuberances 54', a plurality of downward extending serrated teeth 56', and a plurality of plunger downward protuberances 58'.

Figure 8:
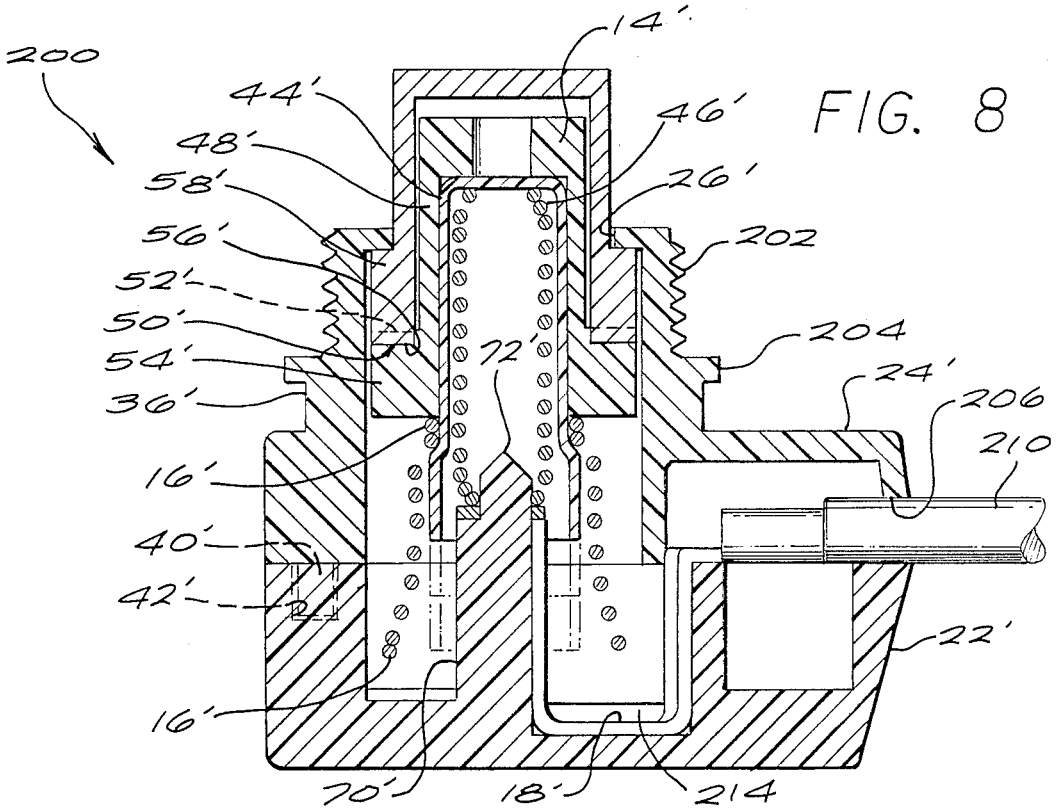
FIG. 8 is a cross-sectional view of the push-button switch taken along the line 8—8 of FIG. 7.

Additionally, the vertically extending port 26' further includes a plurality of vertical splines 60', each having a terminal end 62' with a space 64' between each of said plurality of splines and a ramp shaped ledge 66' located between alternate splines 60'. The structural configuration of the interior of the vertically extending port 26' of the switch 200 is duplicate to that shown in FIG. 3 (except for prime designations) of the corresponding push-bottom switch 10. The operation of the plunger 12' and the ratchet mechanism 14' as is illustrated in the annular cross section of FIG. 8 is duplicate to that shown in FIGS. 2 and 3 and described with reference to the push-button switch 10 of the preferred embodiment.

The top body portion 24' is securely held to the bottom cover portion 22' by a plurality of posts 40' and a plurality of holes 42'. The plurality of holes 42' are shown symmetrically distributed about the bottom cover portion 22' in FIG. 9. A corresponding distribution of the plurality of posts 40' extend from the bottom of the top body portion 24', with a post and hole interference fit shown in phantom in FIG. 8. The electrical conductor 210 is routed into the switch 200 through one of the spaced openings 206 and is physically connected to the input terminal 18', for example, by one of a plurality of conductor compression clamps 212.

The input terminal 18' is shaped to fit the interior structure of the bottom cover portion 22' with the mounting hole 78' located at the distal end of the input terminal 18'. The mounting hole 78' is neatly fit around the cone head 72' for securing the input terminal 18' in position. The input terminal 18' is mounted in a channel 214, and it should be noted that the center post 70' includes a flat surface 216 which faces and receives the input terminal 18', as is the case with the push-button switch 10 of the preferred embodiment.

An output conductor 96' passes through the second of the spaced openings 206 and is connected to an output terminal 20' by a suitable means such as one of the conductor compression clamps 212. The output terminal 20' is shaped to fit the internal structure of the bottom cover portion 22' and is routed through a groove 88' and across the bottom of a centrally located well 30' to a small opening 98'. Note that the center post 70' is connected to and rises from the centrally located well 30' in the bottom cover portion 22' of the switch 200.

When the switch 200 is in the assembled position, as shown in FIG. 8, operation of the plunger 12' provides rotating motion of the ratchet mechanism 14' as previously described. The biasing spring 46' is loosely fit within the metallic cup 44' with the biasing spring always being in electrical communication with the contact spring 16'. The biasing spring 46' is likewise always in electrical contact with the input terminal 18' at the mounting hole 78' around the center post 70'.

Upon applying sufficient pressure to operate the ratchet mechanism 14', the contact spring 16' and the biasing spring 46' make electrical contact between the input terminal 18' and the output terminal 20' completing the electrical circuit through the switch 200. Under these conditions, the switch 200 is in the "stable-on" position. However, when only a modicum of pressure is applied to the plunger 12', the electrical circuit may be completed without indexing the ratchet mechanism 14'. Under these conditions the "momentary-on" feature is available, as was described in the operation of the switch 10.

Each of the electrical terminals including the input terminal 18' and the output terminal 20' are comprised of beryllium copper or in the alternative phosphor bronze for providing superior electrical conductivity. The push-button switch 200 is rated for both alternating current and direct current circuits with the voltage and amperage rating depending upon the design specifications. Therefore, the push-button switch 200 may be employed as a general use electrical switching device to be employed in electronic, general electrical appliance, and automotive switching applications.

Figure 10:
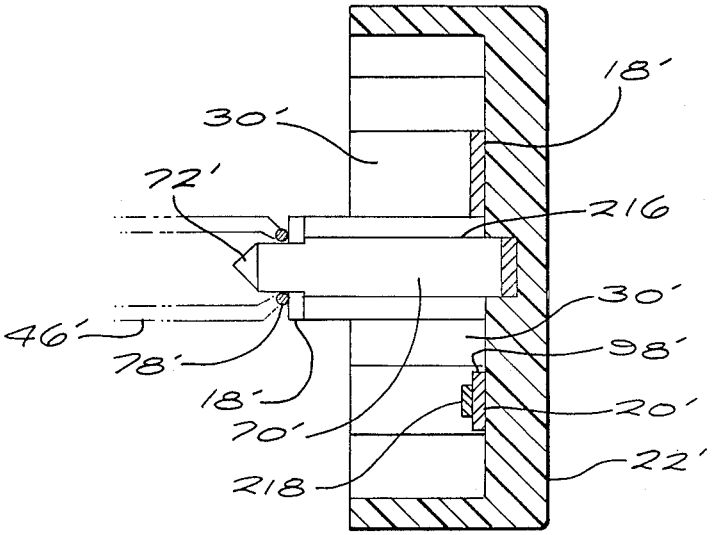
FIG. 10 is a cross-sectional view of the bottom cover portion of the push-button switch taken along the line 10—10 of FIG. 9.

The mounting hole 78' located in the distal end of the input terminal 18' is mounted upon the cone head 72' of the center post 70' as is illustrated in FIG. 10. Mounted directly above the distal end of the input terminal 18' is the biasing spring 46' which makes electrical contact with the input portion of the electrical circuit. The centrally located well 30' is shown surrounding the center post 70' while the output terminal 20' is shown mounted in the small opening 98' located in the well 30'. Further, the input terminal 18' is shown mounted adjacent the floor of the centrally located well 30' and extending vertically upward along the flat surface 216 of the center post 70'.

An elongated bead 218 is stamped into the bottom surface of the output terminal 20' during fabrication so that the output terminal 20' exhibits a raised portion in the top surface after installation of the switch 200. The function of the elongated bead is to provide a high pressure point-to-point contact between the contact spring 16' and the output terminal 20', as is shown in FIG. 9 and in cross section in FIG. 10. The presence of the bead 218 enhances the electrical conductivity between the output terminal 20' and the contact spring 16' when the switch 200 is in the "on-position." The elongated bead is raised approximately six one-thousandths of an inch above the output terminal 20' to form a "half-round" configuration in cross section.

From the foregoing, it will be appreciated that the push-button switch of the invention provides a "momentary-on" feature to an electrical load in addition to a "stable-on" switched condition and that the contact spring employed increases the active length of the switching contact significantly reducing possible spring yielding problems Further, the contact spring exhibits improved resiliency properties enhancing the ratchet switching mechanism and reducing the possibility of permanent spring distortion While several particular forms of the invention have been illustrated and described, it will also be apparent that various modifications can be made without departing from the spirit and scope of the invention. Accordingly, it is not intended that the invention be limited, except as by the appended claims.

What is claimed is:

1. A miniature push-button switching apparatus comprising, in combination;

a switching device;

means for housing said switching device, said housing means comprising a top body portion and a bottom cover portion;

a plunger mounted within and projecting through a vertically extending port of said top body portion for actuating said switching device;

a ratchet mechanism for translating said switching device within said housing means and for connecting and disconnecting an electrical circuit through said switching device, said ratchet mechanism having a temporarily and a permanently energized position and a permanently deenergized position;

a metallic cup mounted within said ratchet mechanism for providing a connection to said electrical circuit through said switching device;

a plurality of terminal conductors mounted within said bottom cover portion for contacting an electrical source and for completing said electrical circuit through said switching device;

a biasing spring positioned between said bottom cover portion and said metallic cup for biasing said plunger; and a helical contact spring having a narrow diameter end and a wide diameter end, said narrow diameter end being rigidly affixed to an end of said metallic cup with said wide diameter end connecting said plurality of terminal conductors when said electrical circuit is connected through said switching device.

2. The miniature push-button switching apparatus of claim 1 wherein said top body portion and said bottom cover portion each comprise a pair of fins for providing a storage space for a light bulb wherein said light bulb comprises an electrical load.

3. The miniature push-button switching apparatus of claim 1 wherein said vertically extending port further includes a threaded collar and a flange for providing support in mounting said switching device.

4. The miniature push-button switching apparatus of claim 1 further including an elongated bead stamped into and raising a portion of an output conductor terminal for providing a high pressure contact between said helical contact spring and said output conductor terminal.

5. The miniature push-button switching apparatus of claim 1 wherein said vertically extending port is cylindrical and includes a plurality of vertically extending splines equally spaced around an inner wall of said cylindrical port, and including a ramp-shaped ledge located between each alternate spline with each spline having a wedge-shaped terminal end.

6. The miniature push-button switching apparatus of claim 5 wherein said ratchet mechanism is comprised of a cylindrical sleeve having a first end and a second end, said second end having a plurality of upwardly extending serrated teeth and a plurality of protuberances, said first end of said ratchet sleeve fitting into said plunger and said second end of said ratchet sleeve being open for receiving said metallic cup.

7. The miniature push-button switching appatatus of claim 6 wherein said plunger is comprised of a cylinder sleeve having a first end and a second end, said first end being closed for forming a push-button and said second end having a plurality of downwardly extending serrated teeth with a plurality of protuberances, said second end being open for receiving said ratchet sleeve wherein said upwardly extending teeth and protuberances of said ratchet sleeve mesh with and are rotatively driven by said downwardly extending teeth and protuberances of said plunger when said switching device is actuated.

8. The miniature push-button switching apparatus of claim 7 wherein said helical contact spring is in electrical communication with an output conductor terminal when said meshed protuberances are seated upon one of said ramp-shaped ledges between alternate splines for providing said permanently energized position.

9. The miniature push-button switching apparatus of claim 7 wherein said helical contact spring is supended above an output conductor terminal when said meshed protuberances are seated between said vertically extending splines for providing said permanently deenergized position.

10. The miniature push-button switching apparatus of claim 7 wherein a downward operation of said plunger forcing said meshed protuberances through said splines with a force inadequate for operating said ratchet mechanism provides said temporarily energized position of said ratchet mechanism when said helical contact spring communicates with an output conductor terminal for energizing an electrical load.

11. A miniature switching apparatus for a flashlight comprising, in combination:

a switching device;

a housing for surrounding said switching device;

a plunger for actuating said switching device, said plunger mounted within and projecting through said housing;

means for translating said switching device within said housing and for connecting and disconnecting an electrical circuit through said switching device, said translating means having a temporarily and a permanently energized position and a permanently deenergized position;

a metallic cup mounted within said translating means for providing a connection to said electrical circuit through said switching device;

a plurality of terminal conductors mounted within said housing for contacting an electrical source and for completing said electrical circuit through said switching device, said terminal conductors in electrical communication with a pair of spring clips for forming a bulb socket for receiving a light bulb;

a biasing spring positioned between said housing and said metallic cup for biasing said plunger; and a helical contact spring rigidly affixed to an external surface of said metallic cup for connecting said plurality of terminal conductors when said electrical circuit is connected through said switching device for energizing and deenergizing said light bulb.

12. A miniature push-button switching apparatus for energizing and deenergizing a light bulb of a flashlight comprising, in combination:

a switching device;

a housing for surround said switching device, said housing comprising a top body portion and a bottom cover portion;

a plunger mounted within and projecting through a vertically extending port of said top body portion for actuating said switching device;

a ratchet mechanism for translating said switching device within said housing and for connecting and disconnecting an electrical circuit through said switching device, said ratchet mechanism having a temporarily and a permanently energized position and a permanently deenergized position;

a metallic cup mounted within said ratchet mechanism for providing a connection to said electrical circuit through said switching device;

a plurality of terminal conductors mounted within said bottom cover portion for contacting an electrical source and for completing said electrical circuit through said switching device, said terminal conductors in electrical communication with a pair of spring clips for forming a bulb socket for receiving said light bulb;

a biasing spring positioned between said bottom cover portion and said metallic cup for biasing said plunger; and a helical contact spring having a narrow diameter end and a wide diameter end, said narrow diameter end being rigidly affixed to an end of said metallic cup with said wide diameter end connecting said plurality of terminal conductors when said electrical circuit is connected through said switching device.

13. A flashlight comprising, in combination:

an enclosure;

a miniature push-button switching device mounted within said enclosure for connecting a light bulb to an electrical source;

a housing for surrounding said switching device, said housing comprising a top body portion and a bottom cover portion;

a plunger mounted within and projecting through a vertically extending port of said top body portion actuating said switching device;

a ratchet mechanism for translating said switching device within said housing and for connecting and disconnecting an electrical circuit through said switching device, said ratchet mechanism having a temporarily and a permanently energized position and a permanently deenergized position;

a metallic cup mounted within said ratchet mechanism for providing a connection to said electrical circuit through said switching device;

a plurality of terminal conductors mounted within said bottom cover portion for contacting said electrical source and for completing said electrical circuit through said switching device, said terminal conductors in electrical communication with a pair of spring clips for forming a bulb socket for receiving said light bulb;

a biasing spring positioned between said bottom cover portion and said metallic cup for biasing said plunger; and a helical contact spring having a narrow diameter end and a wide diameter end, said narrow diameter end being rigidly affixed to an end of said metallic cup with said wide diameter end connecting said plurality of terminal conductors when said electrical circuit is connected through said switching device.

14. A miniature switching apparatus comprising, in combination: p1 a switching device;

means for housing said switching device;

means for actuating said switching device, said actuating means mounted within and projecting through said housing means;

means for translating said switching device within said housing means and for connecting and disconnecting an electrical circuit through said switching device, said translating means having a temporarily and a permanently energized position and a permanently deenergized position;

a plurality of terminal conductors mounted within said housing means for contacting an electrical source and for completing said electrical circuit through said switching device;

a metallic cylindrical cup having a flared end, mounted within said translating means for providing a connection to said electrical circuit through said switching device;

a biasing spring housed within said cup and compressed between said housing means and said metallic cup and housed within said cup for biasing said actuating means; and a helical contact spring rigidly affixed about said flared end of said metallic cup for connecting said plurality of terminals when said electrical circuit is connected through said switching device.

15. The miniature switching apparatus of claim 14 wherein an electrical conduction path is created between said biasing spring, said metal cylindrical cup, and said helical contact spring when said translation means is positioned for closing said switching device.

16. A miniature switching apparatus comprising, in combination:

a switching device;

means for housing said switching device;

means for actuating said switching device, said actuating means mounted within and projecting through said housing means;

means for translating said switching device within said housing means and for connecting and disconnecting an electrical circuit through said switching device, said translating means having a temporarily and a permanently energized position and a permanently deenergized position;

a metallic cup having a flared end and mounted within said translating means for providing a connection to said electrical circuit through said switching device;

a plurality of terminal conductors mounted within said housing means for contacting an electrical source and for completing said electrical circuit through said switching device;

a biasing spring positioned between said housing means and said metallic cup for biasing said actuating means; and a helical contact spring rigidly affixed to an external surface of said metallic cup for connecting said plurality of terminals when said electrical circuit is connected through said switching device wherein said helical contact spring includes a narrow diameter end and a wide diameter end, said narrow diameter end being rigidly affixed to the flared end of said metallic cup and said wide diameter end being suspended above said plurality of terminal conductors for completing said electrical circuit through said switching device.

17. The miniature switching apparatus of claim 16 wherein said helical contact spring has a relatively long active length for reducing the spring yielding factor and for increasing the resiliency of said translating means.

* * * * *